US006155955A

United States Patent [19]

Boss et al.

[11] Patent Number: 6,155,955

[45] Date of Patent: Dec. 5, 2000

[54] OPERATING METHOD FOR A MOTOR VEHICLE DRIVING UNIT

[75] Inventors: Ralf Boss, Kressbronn; Johannes Sorg, Ravensburg, both of Germany

[73] Assignee: ZF Friedrichshafen AG, Friedrichshafen, Germany

[21] Appl. No.: 09/269,374

[22] PCT Filed: Nov. 3, 1997

[86] PCT No.: PCT/EP97/06047

§ 371 Date: Mar. 25, 1999

§ 102(e) Date: Mar. 25, 1999

[87] PCT Pub. No.: WO98/21464

PCT Pub. Date: May 22, 1998

[30] Foreign Application Priority Data

Nov. 8, 1996 [DE] Germany ..... 196 46 069

[51] Int. Cl.[7] ..... F02D 41/14

[52] U.S. Cl. ..... 477/107; 477/110; 123/339.11

[58] Field of Search ..... 477/107, 109, 477/110; 123/339.11–339.17

[56] References Cited

U.S. PATENT DOCUMENTS

| | | | |
|---|---|---|---|
| 4,724,810 | 2/1988 | Poirier et al. | 123/339 |
| 5,000,277 | 3/1991 | Hall, III et al. | 180/6.44 |
| 5,072,711 | 12/1991 | Katayama et al. | 123/486 |
| 5,245,966 | 9/1993 | Zhang et al. | 123/339 |
| 5,457,633 | 10/1995 | Palmer et al. | 364/431.09 |
| 5,484,351 | 1/1996 | Zhang et al. | 477/113 |
| 5,558,178 | 9/1996 | Hess et al. | 180/197 |
| 5,577,474 | 11/1996 | Livshiz et al. | 123/352 |
| 5,666,917 | 9/1997 | Fraser et al. | 123/339.17 X |
| 5,679,085 | 10/1997 | Fredriksen et al. | 475/76 |
| 5,692,472 | 12/1997 | Bederna et al. | 123/350 |
| 5,866,809 | 2/1999 | Soderman | 73/117.3 |
| 5,947,084 | 9/1999 | Russell et al. | 123/339.16 |

FOREIGN PATENT DOCUMENTS

| | | |
|---|---|---|
| 27 51 663 | 5/1978 | Germany . |
| 32 42 299 A1 | 4/1984 | Germany . |
| 35 42 147 A1 | 6/1986 | Germany . |
| 37 35 246 | 5/1988 | Germany . |
| 38 10 724 A1 | 12/1988 | Germany . |
| 38 33 784 A1 | 4/1989 | Germany . |
| 37 39 389 A1 | 6/1989 | Germany . |
| 41 12 982 A1 | 10/1992 | Germany . |
| 4200806C1 | 1/1993 | Germany . |

OTHER PUBLICATIONS

Esders, Hans, Hans–Heinrich Harms, Claus Holländer: "Tendenzen der Hydraulik in Baumaschinen—Neuigkeiten zur Bauma '92", O+P Ölhydraulik und Pneumatik 36, 1992, Nr. 8, S.490–497; Bild 3 mit Beschreibung.

*Primary Examiner*—Khoi Q. Ta
*Attorney, Agent, or Firm*—Davis and Bujold

[57] ABSTRACT

In motor vehicles fitted with overlay steering mechanisms comprising a transmission (2) and a steering transmission (4), substantial amounts of torque flow from the transmission inlet (12) to the steering transmission (4) when cornering. This results in a loss of speed during cornering. According to the method described, the torque flow to the steering transmission (4) is preferably automatically compensated by higher prime mover torque. Driving performance can be enhanced during cornering without needing to design the transmission (2) for higher input torque. The principle disclosed in the invention can be used for other applications.

11 Claims, 2 Drawing Sheets

OPERATING METHOD FOR A MOTOR VEHICLE DRIVING UNIT

The invention concerns a method for operating a driving unit for motor vehicles, specially tracked vehicles, having a prime mover with torque controllable preferably by an electronic control unit, a load transmitter, a driving transmission and at least one other consuming device.

BACKGROUND OF THE INVENTION

Systems for automatic control of a prime mover torque in certain states of operation of vehicles are basically known.

In many vehicles having stepped automatic transmission, a so-called "motor gearing" is used during traction upshifts in order to compensate for the acceleration excess resulting from the rotary mass being decelerated during the gearshift operation. A desired effect is also the reduction of friction in shifting clutches involved.

Also known are different systems for preventing clutch overloads during gearshifts. It is usual, for example, in vehicles with automatic transmissions that, during the gear change from "N" to a driving step "D" or "R", motor power, motor torque or the motor speed are limited.

These systems have in common that the prime mover torque becomes reduced for a brief time during certain shifting operations.

There have further become known methods for operating a driving unit in which the prime mover power is limited in accordance with certain transmission ratios. Such a driving device has been described, for example, in DE OS 3735246. In this known driving device the motor capacity is limited briefly in a reverse gear in order that the transmission does not have to be (over) dimensioned for this load situation. The limitation of the motor capacity is here firmly linked to the condition that a certain gear (reverse gear) be engaged.

Electronic idling speed controls are likewise related to the instant invention. But in such systems it is essential that the systems be tailored to the idling range (load position "0"). Control is here based on a preset idling speed. A consuming device to be engaged as a rule leads to a speed drop until a control reacts to this.

In many manufactured driving units with a transmission having variable (stepped or continuous) ratios for adaptation to different vehicle speeds, additional consuming devices are directly or indirectly driven by the prime mover. The torque flow to such added consuming devices often is not constant and its magnitude can change depending on the shifting or operating state.

First of all, when the torque flow to the added consuming device can assume relatively high values, the driving performance (speed and acceleration) becomes impaired. Specially in tracked vehicles, a steering transmission, when cornering, can be an added consuming device using substantial portions of the prime mover torque so that the effect on the driving performance is considerable. An cross-drive steering transmission with integrated transmission and steering transmission parts is the object of DE 38 33 784.

SUMMARY OF THE INVENTION

The problem on which the invention is based is to reduce the effects of the variable torque absorption, by added consumer devices, upon the driving performance of the vehicle.

This problem is solved by a method according to the present invention.

The compensation of the torque flow to the added consuming device by an increased prime mover torque prevents, according to the degree of compensation, a lowering of the driving performance (for ex., deceleration) of the vehicle without the driver having to increase the load position. If the "Specific load position" above which the compensation acts is the zero load position, the automatic compensation works in the whole load range.

The method can be used advantageously particularly where there are consuming devices whose absorption torque is not determined exclusively by the prime mover speed. Together with the transmission, at least one other consuming device is included in the method. The method and the developments can also be applied in the presence of several consuming devices.

The use of an electronic control unit for the prime mover offers the advantage that the prime mover torque can be controlled in a relatively simple way, for example, by changing as desired the injection amount or ignition angle.

It is fundamental that the performance of a power train is limited by the weakest member thereof. In many cases transmissions are loaded by the prime movers up to admissible limits. It seems necessary for every increase in driving performance to increase together with the motor power the transmitting capacity of the transmission, however this can be problematic due to construction space, costs, or weight considerations.

In the practical use of a vehicle, there are often already increases which help in driving performance and which become important only under certain operating states. An example of such operating states is cornering a tracked vehicle having an overlay steering transmission. Here a considerable portion of the motor power flows to the "steering transmission" consuming device.

An increase in driving performance is possible with another development of the invention. The conditions are that the consuming device removes its absorption torque from the driving train earlier than from the transmission and the admissible input torque on the transmission is then lighter than a potentially maximum prime mover torque. The prime mover torque is upwardly variably limited by a value corresponding to the sum of an admissible input torque on the transmission and the actual torque flow to the consuming device. The meaning of "before the transmission" includes a case in which a consuming device (for example, an auxiliary output) even though situated behind the transmission input shaft is nevertheless before the real transmission part.

In case of full (full power) deviation of the load transmitter and low torque flow to the added consuming device, the maximum possible prime mover torque is not reached. The motor torque is practically permanently limited by the control so that the input torque on the transmission does not exceed an admissible value. In an internal combustion engine this can occur by limiting the injection amount, for example, by reducing the pulse width of an injection signal.

Accordingly as the torque flow rises to the added consuming device, the prime mover torque is compensated as long as enough reserves exist for that.

In a tracked vehicle with cross-drive steering transmission, the torque flow to the consuming device "steering transmission" can be very high. In a so-called "pivot turn" where the vehicle turns with oppositely extending chains around its own vertical axis, almost all the motor power is absorbed by the steering transmission. In a curved radii in which transmission and steering transmission have a similar high torque absorption, substantial increases in driving performance can be achieved. In an assumed vehicle weighing 65 t, said range of the curve radii is between 10 m and 100 m.

Should there exist between prime mover and transmission a reduction step (for example, input gear group) or a hydrodynamic torque converter, it is obvious to calculate, accordingly, the values for the ratios of the prime mover torque to the transmission input torque.

It is not indispensable that the admissible input torque on the transmission be a firmly preset value. When, for example, the transmitting capacity of a clutch determines the admissible input torque of the transmission, it may be convenient to deposit in the control the admissible input torque as a function or a characteristic line dependent on motor speed, hydraulic pressure, temperatures, or—in a stepped transmission—engaged drive gear.

With a computer (microcomputer) preferably integrated in an electronic motor or transmission control unit, the actual torque flow to the added consuming device can be easily determined from signals produced from vehicle data and/or from measured vehicle state and/or environment data. By vehicle data in this sense are to be also understood, parameters of individual vehicle components. It is also clear that the computer is integrated in a combined motor-transmission control unit or that individual vehicle components (consuming devices) are themselves equipped with a corresponding electronic system and provide their respective absorption torque as a signal, preferably to a data bus.

Automatic compensation of the torque flow to the added consuming device, preferably over the whole load range, can be advantageously carried out as follows:

The transmission control unit receives signals used for determining the torque flow to the added consumer device and a load signal for the load transmitter, generates therefrom a signal "torque requirement" and transmits said signal to the motor control unit. The latter controls the prime mover in a manner such that the real prime mover torque corresponds to a great extent to the actual "torque requirement." Depending on the type of prime mover there is controlled a suitable actuation system such as an injection pump.

Another development is particularly adequate when the torque flow to the added consuming device has to be mostly manually compensated by the driver. The transmission control unit here receives signals used for calculating the torque flow to the added consuming device and generates therefrom an actual signal "maximum admissible prime mover torque." The motor control unit receives said generated signal from the transmission control unit and a load signal directly from the load transmitter and controls the prime mover so that the actual prime mover torque does not exceed the "maximum admissible prime mover torque."

According to the signal "maximum admissible prime mover torque", the motor control unit finds a coordination of load signal and actual motor control (for example, injection amount). The range of the automatic compensation depends on the load position above which, based on a torque flow to the added consuming device, the actual motor control is determined. If this load position is the full-load position, the driver must manually compensate in the partial load range. If an increased motor torque does not steadily become automatically available during the existing torque flow to the added consuming device, it can be convenient to introduce this by, such as, the actuation of a kick-down switch.

Higher driving performance can also be advantageous when they are only briefly available, for example, to increase the active safety of occupants of the vehicle. It can thus be convenient briefly to operate a prime mover in an overload operation, specially during torque flow to the added consuming device.

In a tracked vehicle the torque flow to the steering transmission can be advantageously determined, preferably mathematically, by using at least one of the parameters: transmission ratio, steering transmission ratio, reversing resistance coefficient, curve radius, or steering wheel angle. The use of the parameters prime mover speed or of a pump power of a hydropump is advantageous for a hydraulic drive with a hydropump and a hydromotor. It is also obvious to use a torque-measuring device located, preferably where the torque flow to the steering transmission branches off, or at the transmission inlet.

The invention is advantageous if the automatic transmission is a power-shiftable stepped transmission, particularly of a planetary design. The same applies to the design of the steering transmission. However, the use of continuously variable transmissions as the transmission and/or steering transmission is also obvious. Such a continuously variable transmission can be designed, for example, as a hydrodynamic transmission, a hydrodynamically power-split transmission, or a belt-drive transmission.

A turbo-charged multifuel motor offers the advantage of being operable in overload by raising the load pressure. But of course other kinds of prime movers such as gas turbines or electromotors can also be used.

Besides a steering transmission or a hydraulic fan drive, other consuming devices such as air-conditioning equipment or power take-offs can naturally be considered also in the method.

The absorption capacity of an air-conditioning equipment in relation to the motor power needed, for example, in a passenger car in constant motion in flat ground, is not inconsiderable. As a rule, the switching on of the air conditioner compressor makes itself noticeable by an undesirable small loss in velocity which must be compensated by the driver by further lowering the accelerator pedal. An automatic compensation according to the invention results here in unburdening the driver. The possibility of allowing a stronger maximum prime movertorque when the air conditioner compressor is switched on is advantageous in a vehicle where the prime mover could basically transmit a stronger torque than is transmitted by the transmission.

Finally, the use of the method in vehicles having automatic transmissions is particularly simple, for here it is possible in many cases to reach back to interfaces already existing between motor and transmission.

BRIEF DESCRIPTION OF THE DRAWING(s)

The invention is explained in detail herebelow with reference to the enclosed drawings.

In the drawings:

FIG. 1: a torque flow-plan of a tracked vehicle transmission

FIG. 2: two full-load characteristic lines in a motor torque diagram

FIG. 3: a first block diagram

FIG. 4: a second block diagram

DESCRIPTION OF THE PREFERRED EMBODIMENT(s)

Figure 1:
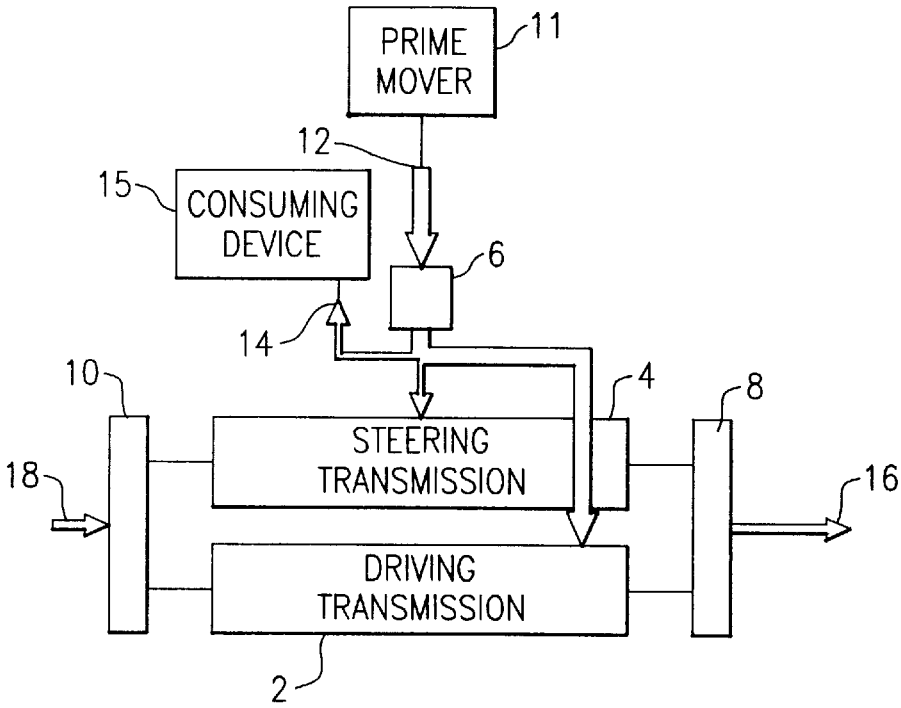

The torque on the transmission inlet 12 (prime mover torque from prime mover 11) effects upon the input shaft of the input gear group 6 a first firm reduction step on the transmission inlet. After the input gear, the torque flow splits into paths to the transmission 2, the steering transmission 4 and a path 14 to the auxiliary units or consuming devices 15 (for example, fan drive). The output torques of the transmission and of the steering transmission are added up in summarizing transmissions 8, 10. According to the driving state, different torque flows 16, 18 result to the two (left and right side) outputs not shown in FIG. 1.

When driving straight ahead no torque flows via the steering transmission 4. Aside from the torque to the auxiliary units 14, the whole torque flows to the transmission 2 and from there, via the summarizing transmissions 8, 10, uniformly to the two outputs.

When cornering one part of the torque produced by the prime mover flows to the steering transmission 4. When cornering the chain outside the curve (not shown) is driven quicker by the speed ratio of the two outputs determined by the steering transmission than the chain inside the curve. Accordingly, the torque is transmitted to the inner output 18 in opposite direction to the torque to the outer output 16.

Depending on the curve radius, the steering transmission uses a considerable portion of the supplied torque 12 whereby, at first, less torque reaches the transmission 2. The method according to the invention now provides, depending on the torque flow to the steering transmission 4 and to the auxiliary units or consuming devices 14, by motor torque control to produce more torque on the transmission inlet 12.

Figure 2:
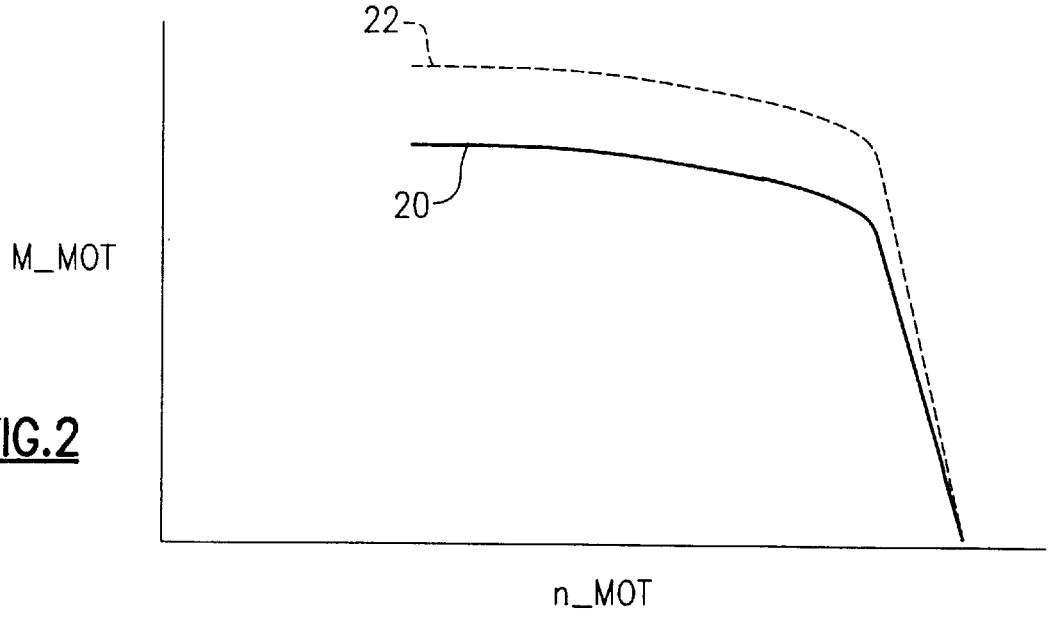

FIG. 2 diagrammatically shows two full-load torque characteristic lines of a prime mover plotted over the motor speed (n_Mot). The first full-load characteristic line 20 applies to straight ahead driving or without added consumer devices and fulfills the condition that the admissible input torque of the transmission be not exceeded. The second dotted full-load characteristic line applies when consuming devices branch off which before the transmission to produce at least the torque difference between the lines shown. If the second full-load characteristic line 22 can be permanently sustained by the motor, the motor is operated steadily throttled when driving straight ahead. An overload operation of the motor exists when only the first full-load characteristic line 20 can be permanently sustained by the motor, even though the motor can for a short time implement the full-load characteristic line 22.

Figure 3:
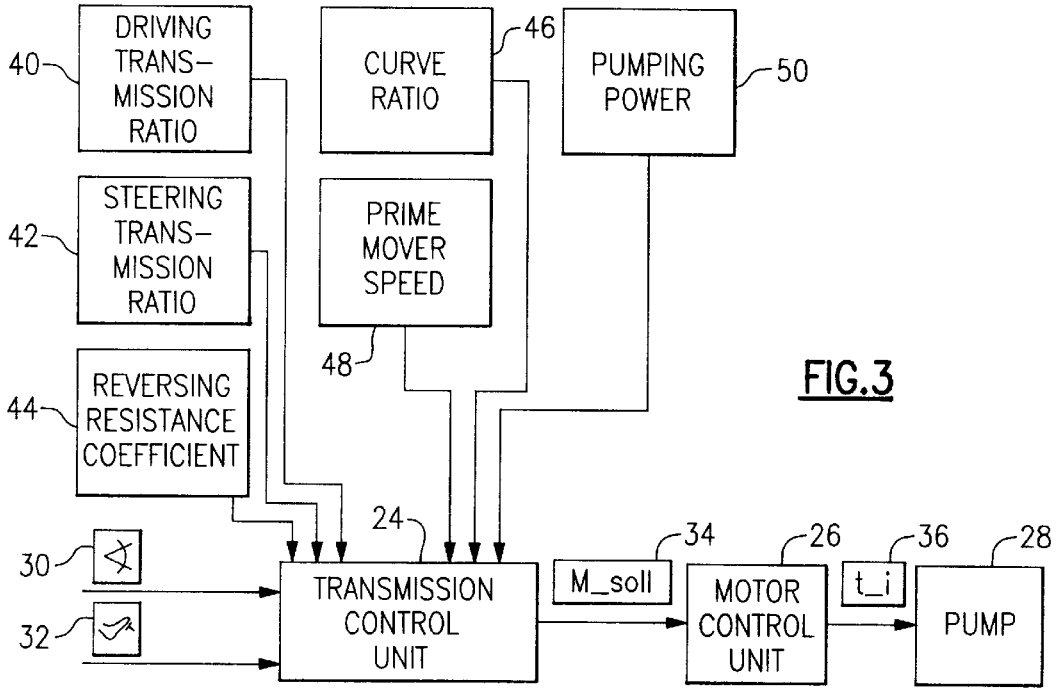
Figure 4:
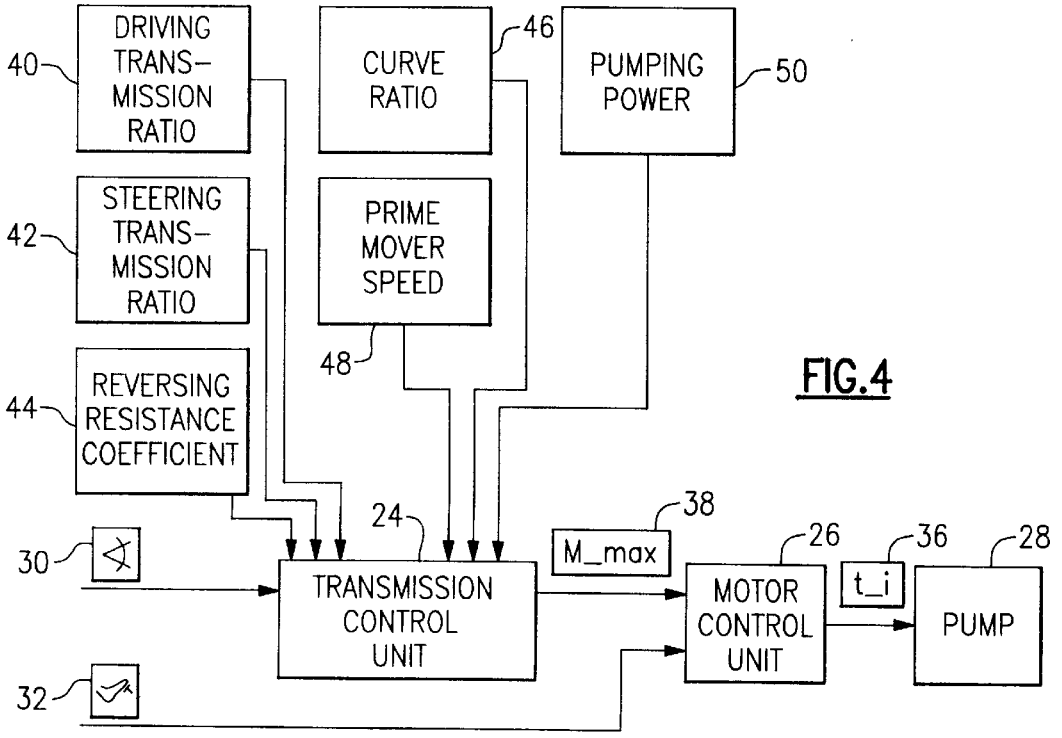

The block diagrams shown in FIG. 3 and FIG. 4 diagrammatically illustrate two ways a method according to the invention can be equipped with a transmission control unit 24 and a motor control unit 26.

In the first embodiment of FIG. 3, the transmission control unit 24 receives a load signal (position of the accelerator pedal 32) and a signal "steering wheel angle" 30, driving transmission ratio 40, steering transmission ratio 42, revering resistance 44, curve radius 46, prime mover speed 48, and pumping power 50. From these signals the transmission control unit determines the torque flow to the steering transmission and adds it to a torque requirement corresponding to the position of the accelerator pedal. The combined value is converted to a signal "torque requirement" 34 and transmitted to the motor control unit (26). According to said torque requirement, the motor control unit produces the signal injection time 36 which is received by a fuel injection pump 28.

This embodiment is specially well-suited to an automatic compensation of the torque flow to the steering transmission over the whole load range.

The second embodiment of FIG. 4 differs from the first in that the load signal (accelerator pedal position 32) is received directly by the motor control unit (26) and the transmission control unit generates from the signal "steering wheel angle" 30 a signal "maximum admissible prime mover torque". The latter is likewise received by the motor control unit.

This embodiment of the method is particularly adequate when the compensation is automatically to take place only in a high load range. In the partial load range the driver has to compensate manually the torque absorbed by the steering transmission when the vehicle must not become slower.

Reference Numerals

2 transmission
4 steering transmission
6 input gear group
8 summarizing transmission outer
10 summarizing transmission inner
12 torque on transmission inlet
14 torque to the auxiliary units (fan drive)
16 torque on outer output
18 torque on inner output
20 full-load line without torque flow to the added consuming device
22 full-load line with torque flow to the added consuming device
24 transmission control unit
26 motor control unit
28 injection pump
30 steering wheel angle
32 accelerator pedal position
34 signal "torque requirement"
36 signal "injection time"
38 signal "maximum admissible prime mover torque

What is claimed is:

1. A method of operating a motor vehicle driving unit having:

a prime mover coupled to supply driving power to both a driving transmission and at least one drive consuming device, the prime mover generating a prime mover torque which is controllable by a motor control unit, and a load transmitter coupled to the prime mover to at least partially control operation thereon, the method comprising the steps of:

drivingly branching off, at a location before the driving transmission, a torque flow to said at least one drive consuming device;

providing an admissible input torque to the drive transmission which is lower than a potentially maximum prime mover torque;

controlling the prime mover torque, via the motor control unit, to a certain position greater than the position of the load transmitter depending on an actual torque flow to said at least one drive consuming device to provide at least partial compensation for the torque flow reaching said at least one drive consuming device;

limiting the prime mover torque by an upper limit which corresponds to a sum of the admissible input torque to the driving transmission and the actual torque flow to said at least one drive consuming device so as to prevent an overload of the driving transmission in case of a low torque flow to said at least one drive consuming device;

receiving, in said transmission control unit (24), said signal (30) used to determine the torque flow to said at least one drive consuming device;

generating, in said transmission control unit (24), a maximum admissible prime mover torque signal (38);

receiving, in said motor control unit (26), said maximum admissible prime mover torque signal (38) generated by said transmission control unit (24);

receiving, in said motor control unit (26), a load signal (32) directly from said load transmitter; and controlling the prime mover so that the actual prime mover torque is prevented for exceeding a maximum admissible prime mover torque.

2. The method according to claim 1, comprising the step of using a computer to determine, from a signal produced from at least one of vehicle data and environmental data, the actual torque flow to said at least one drive consuming device.

3. The method according to claim 1, comprising the step of integrating the computer in one of said motor control unit (26) and a transmission control unit (24).

4. The method according to claim 2 comprising the steps of:

receiving the signal used to determine the torque flow to said at least one drive consuming device;

receiving a load signal (32) from the load transmitter;

generating a torque requirement signal (34) based upon the received signals; and transmitting said torque requirement signal to said motor control unit (26) to control the prime mover in a manner such that the actual prime mover torque substantially corresponds to an actual torque requirement.

5. The method according to claim 1, further comprising the step of controlling said prime mover to operate in an overloaded state for a limited period of time when torque flow to said at least one drive consuming device is present.

6. The method according to claim 1 when used in a tracked vehicle, the method further comprising the step of using an accelerator pedal as the load transmitter and using at least one of a steering component of a cross-drive steering transmission and a fan as the at least one drive consuming device.

7. The method according to claim 1, further comprising the steps of using a steering transmission as the at least one drive consuming device, and using at least one of the following parameters to determine the torque flow distributed to said steering transmission:

a driving transmission ratio (40), a steering transmission ratio (42), a reversing resistance coefficient (44), a curve radius (46), a steering wheel angle (30), a prime mover speed (48), and a pumping power (50).

8. The method according to claim 6, further comprising the step of using a power-shiftable stepped transmission as the driving transmission.

9. The method according to claim 6, further comprising the step of using a power-shiftable stepped transmission as said steering transmission.

10. The method according to claim 1, further comprising the step of using a turbo-charged multifuel motor as the prime mover.

11. The method according to claim 1, further comprising the step of providing an auxiliary output as the at least one drive consuming device.

* * * * *